US009324201B2

(12) United States Patent
Jun

(10) Patent No.: US 9,324,201 B2
(45) Date of Patent: Apr. 26, 2016

(54) VEHICULAR IMAGE PROCESSING APPARATUS AND METHOD OF SHARING DATA USING THE SAME

(71) Applicants: THINKWARE SYSTEMS CORPORATION, Seongnam-si, Gyeonggi-do (KR); INTELLECTUAL DISCOVERY CO., LTD., Seoul (KR)

(72) Inventor: Dong Sok Jun, Seoul (KR)

(73) Assignees: THINKWARE SYSTEMS CORPORATION, Seongnam-si (KR); INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/263,280

(22) Filed: Apr. 28, 2014

(65) Prior Publication Data

US 2014/0324247 A1 Oct. 30, 2014

(30) Foreign Application Priority Data

Apr. 29, 2013 (KR) ..... 10-2013-0047786

(51) Int. Cl.
*G07C 5/00* (2006.01)
*G07C 5/08* (2006.01)

(52) U.S. Cl.
CPC ..... *G07C 5/0866* (2013.01)

(58) Field of Classification Search
CPC ..... G07C 5/008; B60R 25/305
USPC ..... 701/1, 24, 28, 486, 302; 340/436, 903, 340/988
See application file for complete search history.

(56) References Cited

U.S. PATENT DOCUMENTS

| | | | | |
|---|---|---|---|---|
| 2006/0095199 | A1* | 5/2006 | Lagassey | 701/117 |
| 2007/0285512 | A1* | 12/2007 | Kitani et al. | 348/148 |
| 2009/0015684 | A1* | 1/2009 | Ooga et al. | 348/222.1 |
| 2012/0242511 | A1* | 9/2012 | Morgan et al. | 340/989 |
| 2012/0256769 | A1* | 10/2012 | Satpathy | 340/989 |
| 2012/0323480 | A1* | 12/2012 | Kim et al. | 701/409 |
| 2013/0145482 | A1* | 6/2013 | Ricci et al. | 726/28 |
| 2013/0222133 | A1* | 8/2013 | Schultz et al. | 340/539.13 |
| 2013/0325407 | A1* | 12/2013 | Lee | 702/188 |
| 2014/0244770 | A1* | 8/2014 | Kim et al. | 709/206 |

* cited by examiner

*Primary Examiner* — Marthe Marc-Coleman
(74) *Attorney, Agent, or Firm* — Sughrue Mion, PLLC

(57) ABSTRACT

Provided are a vehicular image processing apparatus and a method of sharing data using the same that may verify a driving route of a vehicle or detect and share a location of a vehicle by analyzing recorded images of the image processing apparatus, for example, a black box, thereby increasing data usage and utilization.

16 Claims, 5 Drawing Sheets

VEHICULAR IMAGE PROCESSING APPARATUS AND METHOD OF SHARING DATA USING THE SAME

CROSS-REFERENCE TO RELATED APPLICATION

This application claims the benefit of Korean Patent Application No. 10-2013-0047786, filed on Apr. 29, 2013, in the Korean Intellectual Property Office, the disclosure of which is incorporated herein by reference.

BACKGROUND

1. Field of the Invention

The present invention relates to a vehicular image processing apparatus and more particularly, to a vehicular image processing apparatus and a method of sharing data using the same that may verify a driving route of a vehicle or detect and share a location of a vehicle by analyzing recorded images of the image processing apparatus.

2. Description of the Related Art

An increasing number of vehicle owners install a black box in a vehicle to investigate a cause of a traffic accident and to minimize a dispute between parties involved in the traffic accident. In this regard, mandatory installation of a vehicular black box is recommended in numerous countries.

To date, it has been possible to purchase and attach a large-capacity external memory to increase a data storage capacity of a black box.

Unless a user shares images photographed by a black box mounted in a vehicle, the images may not be properly provided to parties requiring the images for investigating the traffic accident, which may be considered a waste of data. Thus, sharing images photographed by a black box installed in each vehicle with the public is necessary.

However, an inconvenience of an ordinary black box user may be a need to store photographed images in an internal memory of the black box and access a computer with an Internet connection in order to upload the images to a web server. Thus, there is a desire for a device to share black box images.

Technologies related to an image recording apparatus are dominated by passive-type products that store images in a one-dimensional local area. The most popular 2-channel (CH) image recording apparatus may photograph only front and rear images, but not other images, for example, left, right, and side images. To obtain a variety of information in spite of such a situation, a 4-CH image recording apparatus and additional installation of a number of black boxes may necessary.

SUMMARY

An aspect of the present invention provides a vehicular image processing apparatus and a method of sharing data using the same that may verify a driving route of a vehicle or detect and share a location of a vehicle by analyzing recorded images of the image processing apparatus, for example, a black box, thereby increasing data usage and utilization.

According to an aspect of the present invention, there is provided a vehicular image processing apparatus mountable in a vehicle, the apparatus including an impact detector to detect an accident event occurring with respect to the vehicle, a controller to generate a request signal to request a peripheral vehicle near a location at which the detected accident event occurs to transmit recorded data associated with the accident event to an external server, and a communication unit to transmit the request signal to the peripheral vehicle.

The communication unit may broadcast the request signal to the peripheral vehicle.

The communication unit may transmit the request signal to the peripheral vehicle via the external server.

The communication unit may receive the recorded data from the external server based on an access authority set for the recorded data.

The access authority may be set in phases for at least one data type included in the recorded data.

The access authority may be set for an entity that accesses the recorded data.

The access authority may include information regarding whether a retrieval of the recorded data is allowed.

The recorded data may include at least one of driving information corresponding to the accident event, location information corresponding to the accident event, and an external image corresponding to the accident event.

The apparatus may further include a camera module to acquire an external image corresponding to the accident event. The controller may set an access authority by generating recorded data including the external image, and the communication unit may transmit recorded data for which the access authority is set to the external server.

According to another aspect of the present invention, there is also provided a vehicular image processing apparatus mountable in a vehicle, the apparatus including a camera module to acquire an external image of the vehicle, a controller to generate recorded data including an external image corresponding to an accident event and set an access authority for the generated recorded data when the accident event occurs in a vicinity of the vehicle, and a communication unit to transmit the recorded data for which the access authority is set to an external server.

When a request signal is received from a peripheral vehicle near a location at which the accident event occurs, the communication unit may transmit recorded data corresponding to the request signal to the external server.

The controller may analyze the acquired external image, and generate recorded data corresponding to the accident event when an occurrence of the accident event is verified.

The apparatus may further include a microphone to acquire an external sound of the vehicle. The controller may analyze the acquired external sound, and generate recorded data corresponding to the accident event when an occurrence of the accident event is verified.

According to still another aspect of the present invention, there is also provided a data sharing method of a vehicular image processing apparatus mountable in a vehicle, the method including detecting an accident event occurring with respect to the vehicle, generating a request signal to request a peripheral vehicle near a location at which the detected accident event occurs to transmit recorded data associated with the accident event to an external server, and transmitting the request signal to the peripheral vehicle.

The transmitting may include broadcasting the request signal to the peripheral vehicle.

The transmitting may include transmitting the request signal to the peripheral vehicle via the external server.

The method may further include communicating with the external server to receive the recorded data.

The communicating may include receiving the recorded data from the external server based on an access authority set for the recorded data.

The access authority may be set in phases for at least one data type included in the recorded data.

The access authority may be set for an entity that accesses the recorded data.

The access authority may include information regarding whether a retrieval of the recorded data is allowed.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
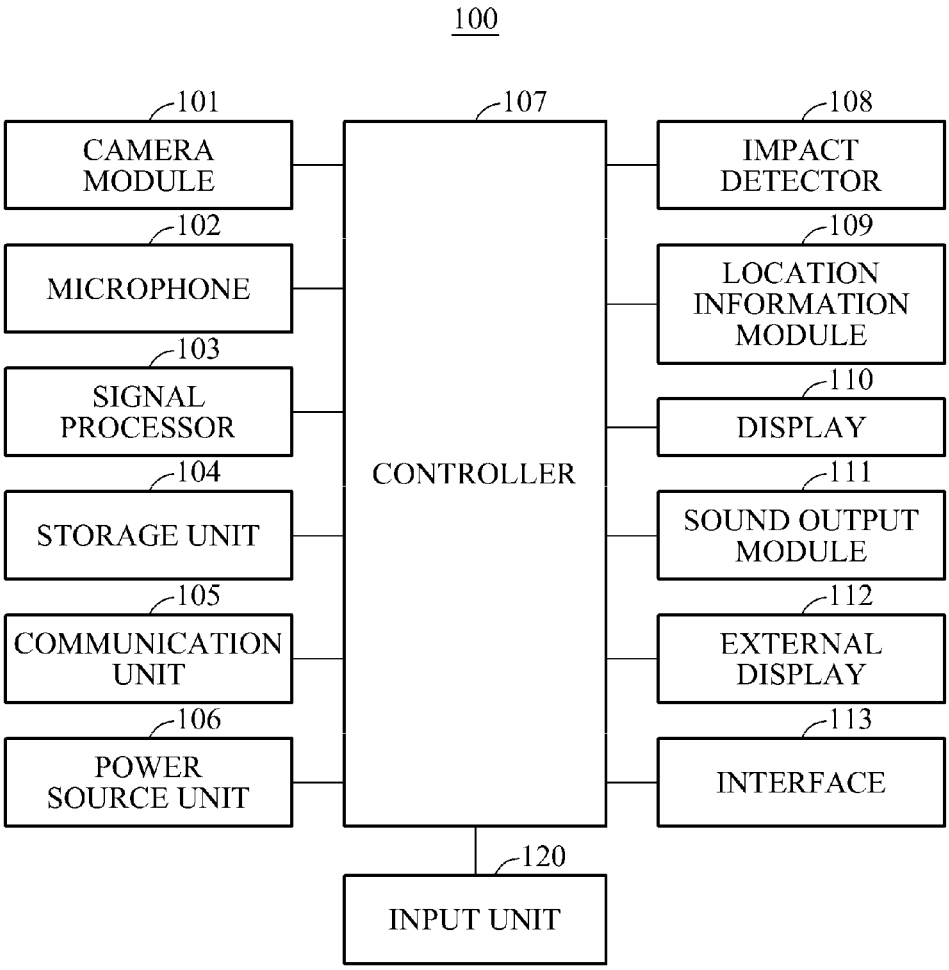
FIG. 1 is a block diagram illustrating a configuration of a vehicular image processing apparatus mountable in a vehicle according to an embodiment of the present invention.

Purposes, features and advantages of the present invention will clearly appear through the detailed descriptions given below with reference to the accompanying drawings. Hereinafter, exemplary embodiments are described in detail by referring to the drawings, wherein like reference numerals refer to the like elements throughout. When it is determined that a detailed description is related to a related known function or configuration which may make the purpose of the present disclosure unnecessarily ambiguous in the description, such a detailed description will be omitted.

Hereinafter, a vehicular image processing apparatus according to the present invention will be described in more detail with reference to the accompanying drawings. The suffixes "module" and "unit" used for constituent elements disclosed in the following descriptions are merely intended for ease of description of the specification, and the suffixes themselves do not provide any special meaning or function. Therefore, it should be noted that the suffixes "module" and "unit" may be used interchangeably.

FIG. 1 is a block diagram illustrating a configuration of a vehicular image processing apparatus 100 according to an embodiment of the present invention.

The image processing apparatus 100 for a vehicle may also be referred to as a black box apparatus.

Referring to FIG. 1, the image processing apparatus 100 may include a camera module 101, a microphone 102, a signal processor 103, a storage unit 104, a communication unit 105, a power source unit 106, a controller 107, an impact detector 108, a location information module 109, a display 110, a sound output module 111, an external display 112, an interface 113, and an input unit 120.

The camera module 101 may acquire an external image corresponding to an accident event. The camera module 101 may acquire an external image of a vehicle. For example, the camera module 101 may photograph a front, rear, side, or internal image of the vehicle, and transmit the photographed image to the signal processor 103. The photographed image may be compressed by the signal processor 103 and stored in the storage unit 104, or may be immediately stored in the storage unit 104 without being compressed. Based on a system configuration, the camera module 101 may include a single camera to photograph a front image. In a case in which the camera module 101 includes a plurality of cameras, each camera may be directed to a front, rear, side, and interior of the vehicle using various methods, based on a purpose.

The microphone 102 may acquire at least one of an external sound and an internal sound of the vehicle. For example, the microphone 102 may record a voice or a sound originating internally or externally and transmit the recorded voice or sound to the signal processor 103. The transmitted recorded voice or sound may be compressed by the signal processor 103 and stored in the storage unit 104, or may be immediately stored in the storage unit 104 without being compressed. The recorded voice or sound may relate to a sound made by an external impact, or a situation occurring internally and externally. The recorded voice or sound and the photographed image may be helpful in recognizing conditions at the time of an accident.

The signal processor 103 may perform compression to reduce a volume of image data photographed by the camera module 101. The image data may be provided in a form of a number of frames gathered based on a time axis. The image data may correspond to successive photographs captured during a provided period of time. Since a volume of such images may be overly great without compression, storing the original images in a memory may be inefficient. Thus, compression may be performed on digitally-converted images. A video may be compressed using a method using a characteristic of a vision sensitive to a low-frequency component, a spatial correlation, and a correlation between frames. Since original data may be lost due to compression, the image data may need to be compressed at a suitable ratio to verify conditions related to a vehicle at a time of a traffic accident. A video may be compressed using one of various video codecs, for example, H.264, moving picture experts group (MPEG)-4, H.263, and H.265/high efficiency video coding (HEVC). The image data may be compressed using a method supported by the vehicular image processing apparatus 100.

The signal processor 103 may compress data recorded by the microphone 102. The signal processor 103 may compress and encode the recorded image and audio data to restrict access to the data.

The storage unit 104 may store the recorded image and audio data as a single file or two files based on a storage period. For example, when the storage period corresponds to 30 seconds, an image and a sound recorded for the first 30 seconds may be compressed and stored as a video file, and an image and a sound recorded for another 30 seconds may be continuously compressed and stored.

The storage unit 104 may store different types of data in different storage areas partitioned based on a recording mode. For example, data recorded during driving and data recorded during parking may be stored in different folders, and data recorded at ordinary times and data recorded by an event may be stored in different folders.

The storage unit 104 may be provided in an internal portion of the vehicular image processing apparatus 100, provided to be detachable through a port provided in the vehicular image processing apparatus 100, or provided in an external portion of the vehicular image processing apparatus 100. When the storage unit 104 is provided in the internal portion of the vehicular image processing apparatus 100, the storage unit 104 may be provided in a form of a disk drive or a flash memory. When the detachable storage unit 104 is provided in the vehicular image processing apparatus 100, the storage unit 104 may be provided in a form of a secure digital (SD) card, a micro SD card, or a universal serial bus (USB) memory. When the storage unit 105 is provided in the external portion of the vehicular image processing apparatus 100, the storage unit 105 may be present in another device or a storage space of a server through the communication unit 105.

The communication unit 105 may configure a connection between the vehicular image processing apparatus 100 and a server, another vehicle, or another device to exchange a recorded image or sound. In addition, the communication unit 105 may enable vehicular information or environmental information to be transmitted to and received from the server, the other vehicle, or the other device. The communication unit 105 may support wireless networks, for example, wireless-fidelity (Wi-Fi), Bluetooth, third generation (3G), long-term evolution (LTE), worldwide interoperability for microwave access (WiMAX), and wireless gigabit alliance (WiGig), and wired networks, for example, Ethernet, and a modulator-demodulator (MODEM).

The power source unit 106 may receive a power from an external power source or an internal battery, and supply operational power to the vehicular image processing apparatus 100. When a vehicle is started, a power of the vehicle may be applied to the vehicular image processing apparatus 100 to charge a chargeable battery thereof. When an engine of the vehicle is stopped, the power of the rechargeable battery may be supplied to the vehicular image processing apparatus 100.

The controller 107 may generally control an overall operation of the vehicular image processing apparatus 100. The controller 107 may include a multimedia module to play back multimedia data. The multimedia module may be included in the controller 107, or provided separately from the controller 107.

The controller 107 may set an operating mode of the vehicular image processing apparatus 100 based on a signal of the impact detector 108 or whether the vehicle is travelling. The controller 107 may perform an ordinary recording function while the vehicle is travelling, and perform an event recording function when an impact event is detected by the impact detector 108. The controller 107 may control the vehicular image processing apparatus 100 to perform a parking recording function by determining the impact event detected by the impact detector 108 or a movement of an object recorded by the camera module 101 while the vehicle is being parked.

The impact detector 108 may detect an accident event occurring with respect to the vehicle. When an impact applied to the vehicle is detected or a change in an acceleration is greater than or equal to a predetermined level, the impact detector 108 may generate a signal corresponding to the event, for example the accident event, and transmit the generated signal to the controller 107. The impact detector 108 may include an acceleration sensor, and an earth magnetic field sensor to detect an impact or an acceleration.

The location information module 109 may correspond to a module to verify or obtain a location of the vehicular image processing apparatus 100. A representative example of the location information module is a global positioning system (GPS) module.

The location information module 109 may continuously calculate a current location of the vehicle in real time, and calculate speed information of the vehicle based on calculated locations.

The display 110 may display or output information processed by the vehicular image processing apparatus 100.

For example, the display 110 may enable the image and sound recorded by the camera module 101 to be displayed in real time or at a desired time. The display 110 may display recording settings to be easily set by the controller 107, and may enable a user to easily select and set a desired function through a touch input.

The display 110 may include at least one of a liquid crystal display (LCD), a thin film transistor-liquid crystal display (TFT LCD), an organic light emitting diode (OLED), a flexible display, and a three-dimensional (3D) display.

In a case in which the display 110 and a sensor configured to sense a touch motion, hereinafter, referred to as a "touch sensor", are provided in a form of a mutual layer, hereinafter, simply referred to as a "touch screen", the display 110 may be used as both an input device and an output device. The touch sensor may be provided in a form of, for example, a touch film, a touch sheet, and a touch pad.

The sound output module 111 may output audio data received by the communication unit 105 or stored in the storage unit 104. The sound output module 111 may output an audio signal related to a function performed by the vehicular image processing apparatus 100.

The sound output module 111 may include a receiver, a speaker, and a buzzer. The sound output module 111 may output a sound through an earphone jack. A user may connect an earphone to the earphone jack, and hear an output sound.

The external display 112 may refer to a light emitting device, for example, a light emitting diode (LED), and a light. The external display 112 may inform about an operating state of the vehicular image processing apparatus 100, or may provide a light for an easy control of the vehicular image processing apparatus 100, for example, a button or a touch.

The interface 113 may act as a bridge between the vehicular image processing apparatus 100 and all external devices to be connected to the vehicular image processing apparatus 100. The interface 113 may receive data or a power from an external device and transfer the data or the power to each constituent element of the vehicular image processing apparatus 100, or may enable internal data of the vehicular image processing apparatus 100 to be transmitted to an external device. For example, the interface 113 may include a wired/wireless headset port, an external charger porter, a wired/wireless data port, a memory card port, a port configured to connect a device including an identification module, an audio input/output (I/O) port, a video I/O port, and an earphone port.

A user may generate input data to control an operation of the vehicular image processing apparatus 100 through the input unit 120. The input unit 120 may include a key pad, a dome switch, a resistive/capacitive touch pad, a jog wheel, and a jog switch.

Figure 2:
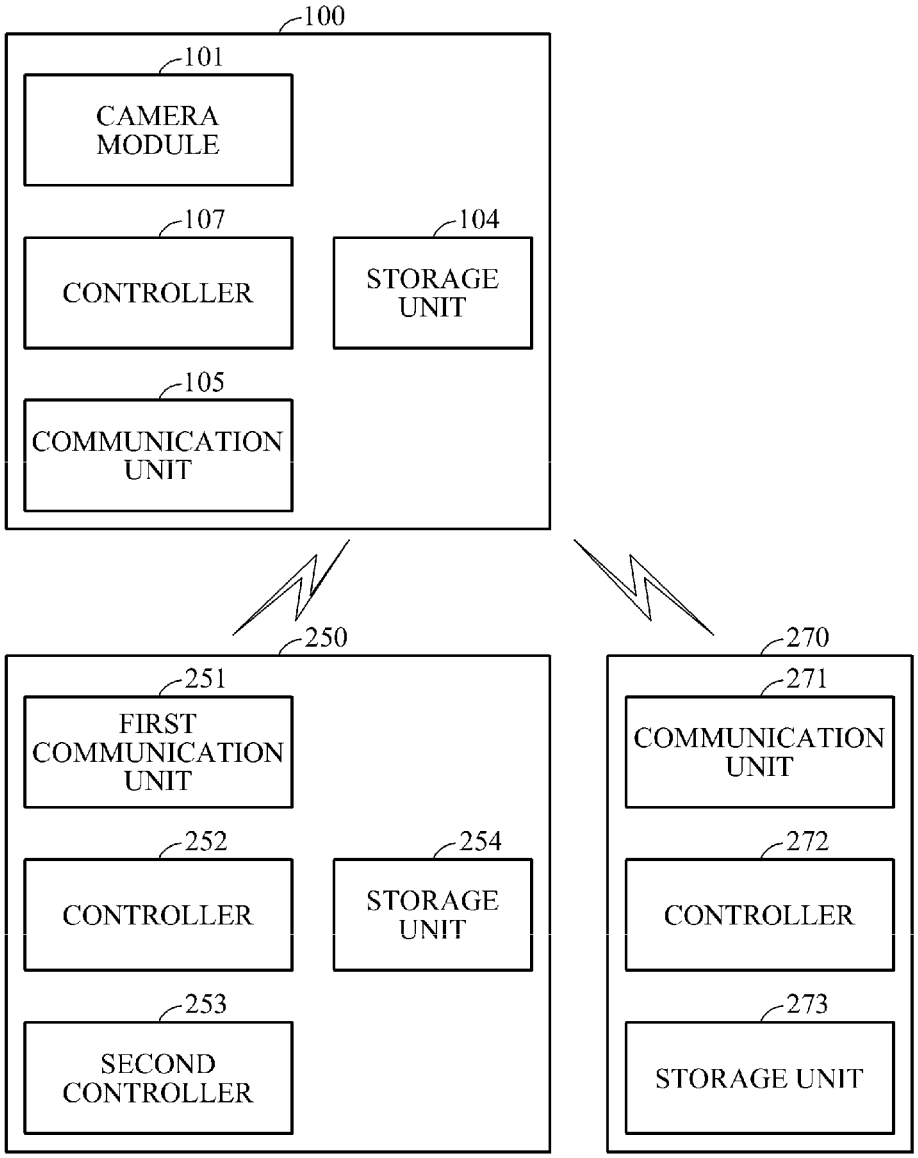
FIG. 2 is a block diagram illustrating a vehicle image processing system according to an embodiment of the present invention.

FIG. 2 is a block diagram illustrating a vehicular image processing system according to an embodiment of the present invention.

Referring to FIG. 2, the vehicular image processing system may include the vehicular image processing apparatus 100 mounted in a vehicle, a sharing server 250 to which the vehicular image processing apparatus 100 uploads photographed images to be shared, and a backup server 270 to which the vehicular image processing apparatus 100 uploads images photographed in a normal mode.

The camera module 101 of the vehicular image processing apparatus 100 may convert input light to an image through an imaging device, for example, a charge-coupled device (CCD), and a complementary metal-oxide-semiconductor (CMOS), and output the converted image to the controller 107. The controller 107 may determine a sharing mode or a normal mode based on a preset criterion, and transmit the image photographed by the camera module 101 to the sharing server 250 or the backup server 270 through the communication unit 105 based on a result of the determining.

The controller 107 may store the image photographed by the camera module 101 in the storage unit 104. The storage unit 104 may correspond to a flash memory, an SD card, or an internal memory.

The sharing server 250 may receive an image set to the sharing mode and transmitted wirelessly from the vehicular image processing apparatus 100 through a first communication unit 251, and share the received image via a network.

A controller 252 of the sharing server 250 may store the image received from the vehicular image processing apparatus 100 in a storage unit 254, and may be connected to an external network through a second communication unit 253.

The first communication unit 251 may be connected to the vehicular image processing apparatus 100 through wireless communication, for example, Wi-Fi, LTE, wireless broadband (WiBro), and a code division multiple access (CDMA). The second communication unit 253 may be connected to other users via a wired network or a wireless network.

The sharing server 250 may correspond to, for example, a server that provides a social networking service (SNS). The sharing server 250 may enable a user to share a post with friends, read a post of a friend from a homepage of the user without visiting the homepage of the friend, and utilize text and multimedia, for example, a photograph, and a video. Such sharing servers are Facebook, Google, Twitter, Cyworld, Mypeople, Kakao Talk, Line, Dropbox, and the like.

The backup server 270 may store a backup of an image set to the normal mode and transmitted by the vehicular image processing apparatus 100.

A controller 272 may store a backup of an image received through a communication unit 271 in a storage unit 273. A user may connect to the Internet at home or another location to download the image photographed in the normal mode, and may download the image from the backup server 270.

Figure 3:
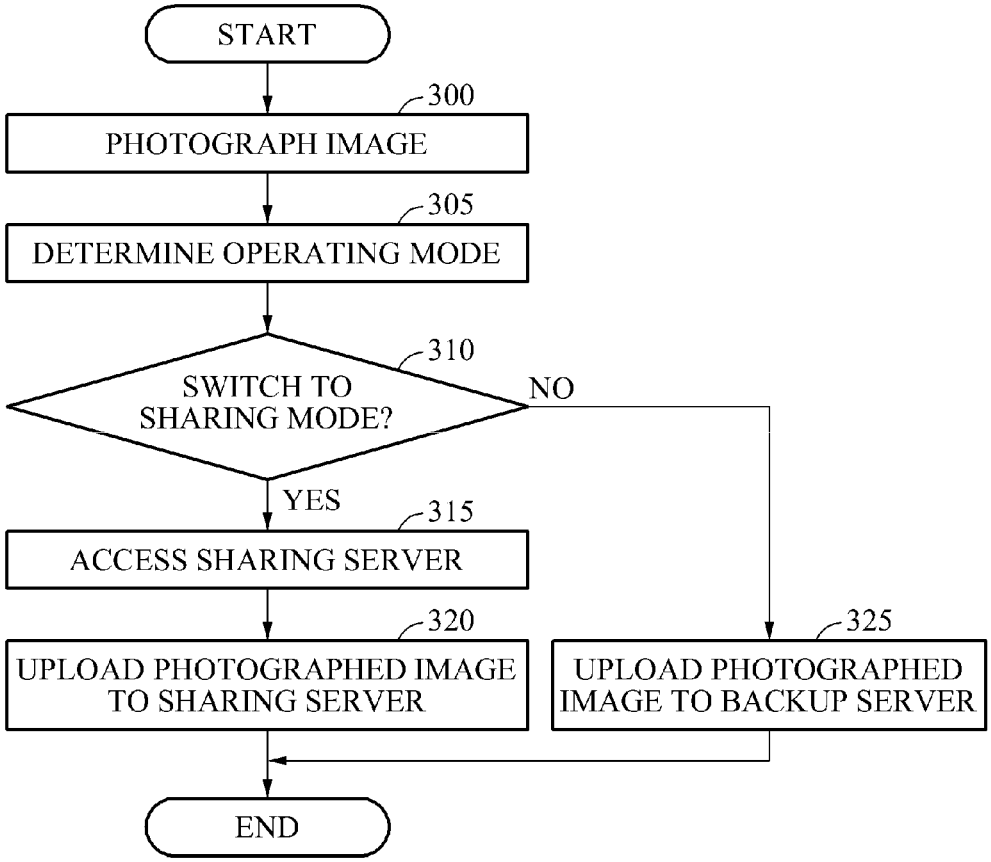
FIG. 3 is a flowchart illustrating a method of sharing data according to an embodiment of the present invention.

<FIG. 3> Mode Switching

FIG. 3 is a flowchart illustrating a method of sharing data according to an embodiment of the present invention. The data sharing method may be implemented by the vehicular image processing apparatus 100 of FIG. 1 and the vehicular image processing system of FIG. 2. Hereinafter, the data sharing method and operations of the vehicular image processing apparatus 100 and the vehicular image processing system to implement the same will be described in detail with reference to the drawings.

Referring to FIG. 3, in operation 300, the controller 107 may photograph an image using the camera module 101. In operation 305, the controller 107 may determine an operating mode of the vehicular image processing apparatus 100. The operating mode of the vehicular image processing apparatus 100 may be determined based on whether an image of an accident or a moving violation is included in a recorded image as a result of analyzing the recorded image.

When the operating mode of the vehicular image processing apparatus 100 is determined, the controller 107 may determine whether the operating mode is to switch to a sharing mode in operation 310. When switching to the sharing mode is determined, the controller 107 may access the sharing server 250 in operation 315, and upload the photographed image to the sharing server 250 in operation 320. Conversely, when the operating mode is determined to be a normal mode, rather than the sharing mode, the controller 107 may upload the photographed image to the backup server 270 in operation 325.

<Data Sharing>

Figure 4:
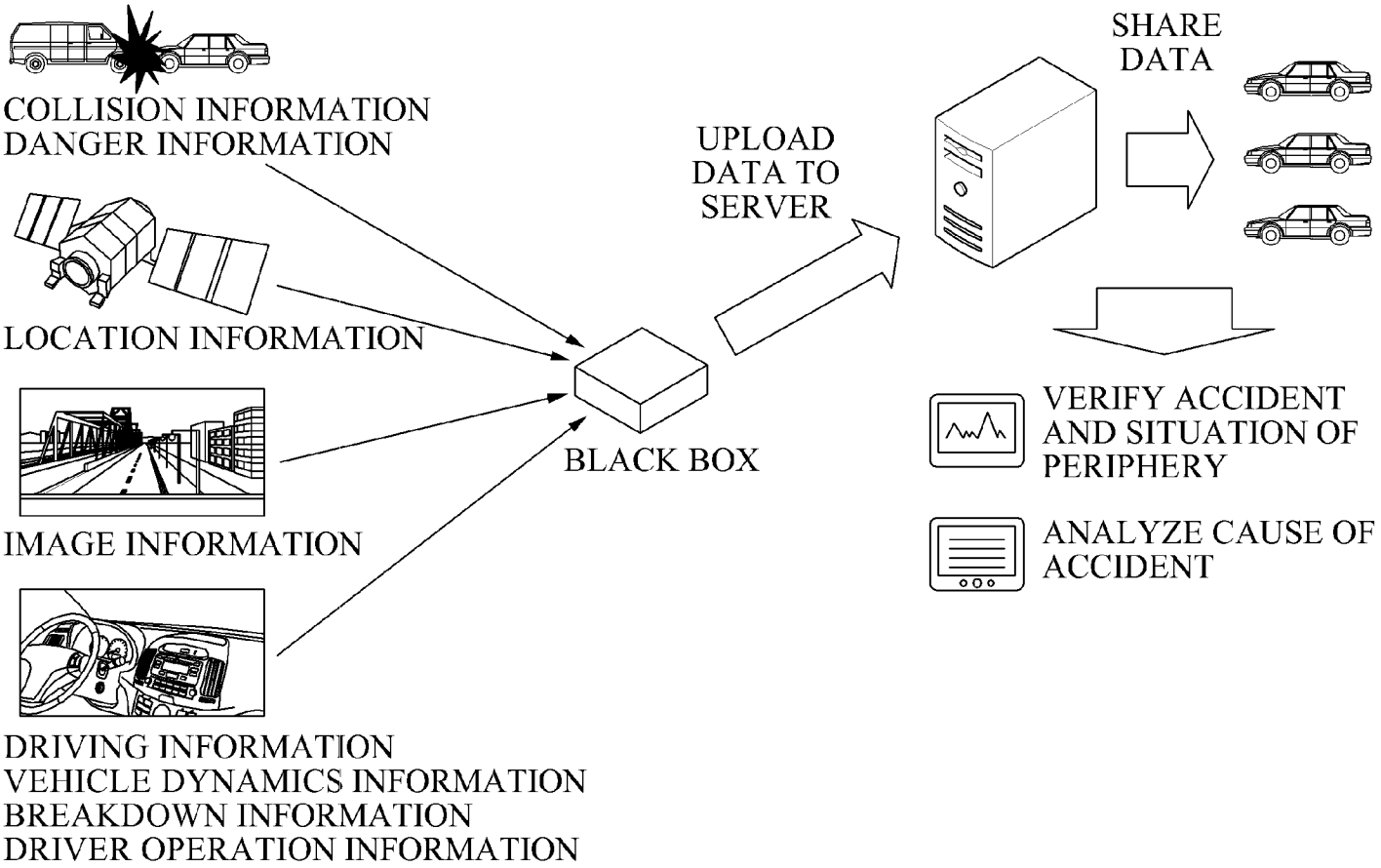
FIG. 4 illustrates an implementation of a method of sharing data according to an embodiment of the present invention.

FIG. 4 illustrates an implementation of a method of sharing data according to an embodiment of the present invention.

The controller 107 of the vehicular image processing apparatus 100, for example, a black box, may upload a recorded image to be analyzed and shared to a server, and assign an access authority in phase by setting a public scope based on a type of data, for example, a type of information included in the recorded data. For example, the communication unit 105 may receive recorded data from an external server based on the access authority set with respect to the recorded data. The recorded data refers to an external image corresponding to an accident event and information related to the accident event, and may include driving information, location information, and the external image corresponding to the accident event. The driving information may include information on a condition of the vehicle during driving, and information on traffic conditions. The location information may include information on a location at which the accident event occurs.

The controller 107 may expose time information and location information with respect to the uploaded recorded image, and may enable a requester to confirm whether the recorded image corresponds to requested information by providing a preview and information on a driving direction in response to a request for use of the recorded image. The access authority may be set to provide additional information by verifying whether an apparatus owned by a user requesting the recorded data is the same as an apparatus used to photograph the recorded data or was manufactured by the same manufacturer.

For example, the access authority may be set for an entity that accesses the recorded data stored in the external server. The access authority may include information regarding whether a retrieval of the recorded data is allowed. In this example, the external server may include a server operated by the manufacturer, or a community server. The access authority may be set to allow a user registered with the external server to access public data, and to enable an unregistered user to search for and download the data with payment of prescribed fees.

The controller 107 may enable settings to upload a selected image file so that an owner of the vehicular image processing apparatus 100 may selectively share a recorded image.

The controller 107 may enable settings to upload an event image and a selected ordinary image, and to expose a time of photograph and location information. When a request for playback of the uploaded image is present, the requested image may be played back with an approval of the owner of the image.

Figure 5:
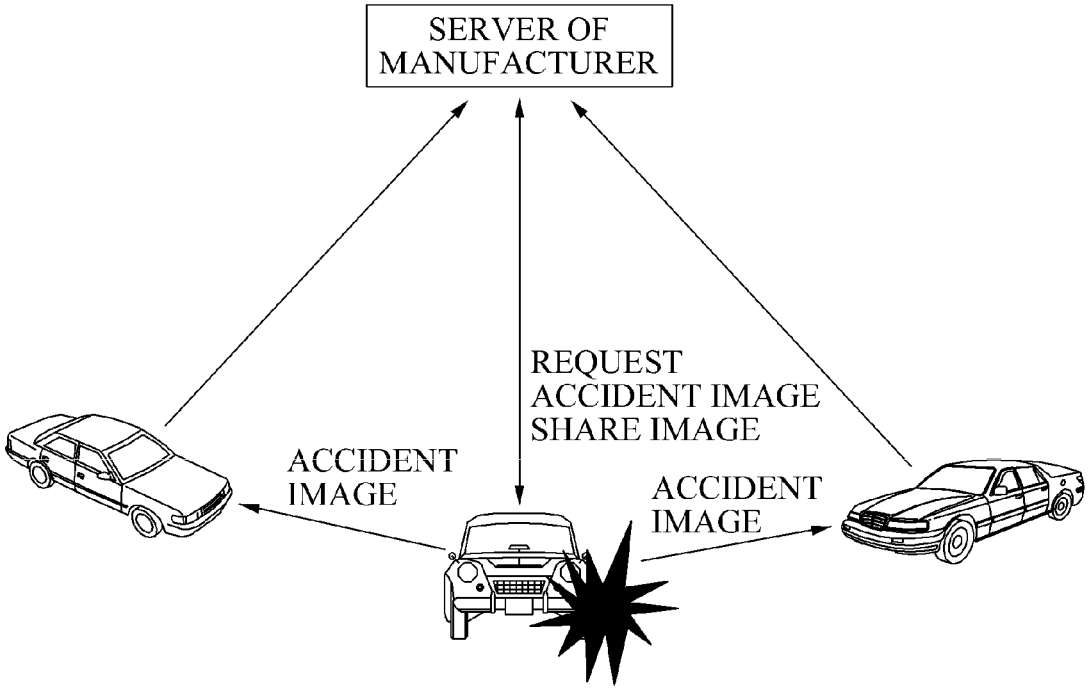
FIG. 5 illustrates an implementation of a method of sharing data according to another embodiment of the present invention.

<FIG. 5> Accident or Event Recorded Image Sharing

FIG. 5 illustrates an implementation of a method of sharing data according to another embodiment of the present invention.

When an accident event occurs with respect to a vehicle, it is possible to request recorded image data from a peripheral vehicle through a server, and enable the recorded image data of the peripheral vehicle to be transmitted to a server of a predetermined organization. For example, the controller 107 may generate a request signal to request a peripheral vehicle near a location at which the accident event is detected to transmit recorded data associated with the accident event to an external server. The communication unit 105 may transmit the request signal to the peripheral vehicle, and communicate with the external server to receive the recorded data.

In another example, when an accident event occurs with respect to a vehicle, a black box of the vehicle may request recorded image data from a peripheral vehicle through broadcasting, and enable a recorded image data of the peripheral vehicle in a corresponding time slot to be transmitted to a server of a predetermined organization. For example, the communication unit 105 may broadcast a request signal to a peripheral vehicle near a location at which an accident event occurs. The communication unit 105 may transmit the request signal to the peripheral vehicle via an external server. Only an authorized entity may be allowed to access the accident image uploaded to the server of the predetermined organization.

The controller 107 may set an access authority by generating recorded data including an external image, and the communication unit 105 may transmit recorded data for which the access authority is set to the external server. An event image may be generated and uploaded to a server by detecting an impact applied to the vehicle using an acceleration sensor included in the black box.

When an accident event occurs in a periphery, the controller 107 may generate recorded data including an external image corresponding to the accident event, and set an access authority with respect to the generated recorded data. The communication unit 105 may transmit the recorded data for which the access authority is set to the external server. When a request signal is received from a peripheral vehicle near a location at which the accident event occurs, the communication unit 105 may transmit recorded data corresponding to the request signal to the external server. When an occurrence of the accident event is verified as a result of analyzing an external image and an external sound, the controller 107 may generate recorded data corresponding to the accident event. For example, when a sound determined to be associated with an accident through sound analysis is detected in the periphery, an event image may be generated and uploaded to a server. When an image determined to be a minor collision between vehicles through image analysis is detected, an event image may be generated and uploaded to a server.

When an event determined to be an accident occurs with respect to a vehicle, a request signal to request a recorded image from a peripheral vehicle may be transmitted via a network. When recorded data corresponding to a requested time and location is present, an opponent vehicle, for example, the peripheral vehicle, may encrypt and upload the recorded data to a server so that only an accident settlement organization, for example, a law enforcement organization, may access the recorded data. When the recorded data corresponding to the requested time and location is present, the opponent vehicle may transmit contact information of an owner of the vehicle in possession of the recorded data to the requesting vehicle.

<Image Transmission Format of Black Box>

An image photographed by a front, rear, or side camera of a black box may be transmitted along with additional information to an analysis server. The additional information may include a recognized license plate number of a vehicle included in a recorded image, or a portion of an image related to the license plate number. The additional information may include location information, time information, and speed information of the vehicle verified by receiving GPS signals.

<Image Analysis and Sharing at Analysis Server>

A driving route of a vehicle may be analyzed by an analysis server based on a recorded image and additional information transmitted from a black box of each vehicle, for example, information on a license plate number, time information, location information, and speed information of the vehicle. A portion that cannot be generated due to an absence of a recorded image may be expressed as an empty section when a driving route of the vehicle is generated, and an optimal route may be extracted based on an empty time and a repositioned location, whereby the driving route of the vehicle may be tracked. When information on a license plate number of the vehicle is not included in the recorded image when the recorded image is transmitted to the server, the information on the license plate number of the vehicle may be extracted by analyzing a driving route of a predetermined vehicle using vehicle license plate number recognition technology.

Using the vehicle license plate number recognition technology, when an image of an accident or a moving violation of the predetermined vehicle is present in the server and it is verified that an owner of the predetermined vehicle is a user registered with the server, corresponding information may be provided to the user through a text message or an SNS of the user.

The analysis server may analyze the recorded image, and set a spot at which an accident or a violation of the traffic regulations occurs as a danger spot. A type of the accident or a type of moving violation with respect to the corresponding spot may be stored in a database, and a relatively frequent type of accident or moving violation may be marked with an additional indicator. Data related to the set danger spot may be transmitted to a user registered with the server. When a navigation function is performed, the user may be informed of a danger area at the corresponding spot, along with the type of the accident or moving violation.

When a user accesses the analysis server to search for image information, only a route changed over time with respect to a predetermined vehicle may be verified. The user may perform the search by adding search conditions about a location, a time, and a danger area.

When content related to driving information is storable in an image, a comprehensive analysis of cause of accident may be performed by estimating information in an image of a vehicle and an accident image of a peripheral vehicle. For example, by comprehensively analyzing a sudden unintended acceleration accident, whether the accident occurred due to driver negligence may be verified.

In an example of a method of sharing a recorded image of a black box, sharing of the recorded image may be restricted to a black box of the same manufacturer or a black box related to an image sharing partnership. A black box may record an accident image in a periphery, store the image, and automatically transmit the recorded image and location information to an aligned server or a database of a manufacturer using a network of a wireless telecommunications operator. The recorded image and the location information may be manually transmitted at a request of a user. When the black box is connected to a network, the recorded image may be automatically uploaded. The uploaded image may be shared with registered users.

The vehicular image processing apparatus and the method of sharing data using the same may achieve the following effects.

According to exemplary embodiments of the present invention, through integrated management of recorded images or sounds, recorded images of a black box may be utilized rather than being deleted. Significant recorded images or sounds may be encrypted to prevent data fabrication and invasion of privacy by indiscreet distribution of the recorded image.

According to exemplary embodiments of the present invention, by utilizing data of a black box as evidence for an accident settlement, accident images from various angles may be acquired and used for an objective accident settlement, and may also be utilized by an insurance company.

The data sharing method according to the above-described exemplary embodiments of the present invention may be recorded in computer-readable media including program instructions to implement various operations embodied by a computer.

The data sharing method may be executed as software. The elements of the present invention can be code segments which execute necessary tasks if the present invention is executed as software. Programs or code segments may be stored in a processor-readable medium or may be transmitted by a computer data signal combined with a carrier wave over a transmission medium or communication network.

The computer-readable media include any data storage device that can store data which can thereafter be read by a computer system. Examples of the computer-readable recording medium include read-only memories (ROMs), random-access memories (RAMS), compact disk (CD)-ROMs, digital video disk (DVD)-ROMs, DVD-RAMs magnetic tapes, floppy disks, hard disks, and optical data storage devices. In addition, the computer-readable media may be distributed to computer systems over a network, in which computer-readable codes may be stored and executed in a distributed scheme Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims. The present invention is not limited to the above-described exemplary embodiments, but the entirety or part of the exemplary embodiments may be selectively combined to make various modifications.

What is claimed is:

1. A vehicular image processing apparatus mountable in a vehicle, the apparatus comprising:

a camera module to acquire an external image of the vehicle;

an impact detector to detect an accident event occurring with respect to the vehicle;

a controller to access an external server to request for recorded data associated with the accident event in the external server; and a communication unit to receive the recorded data from the external server, wherein the controller is configured to determine an operation mode based on at least one of the external image acquired by the camera module and detection of the accident event by the impact detector, and upload the external image of the vehicle to a backup server in response to determining that the operation mode is a normal mode in which the accident event is not detected, and upload the external image of the vehicle to the external server to be shared via the network in response to determining that the operation mode is a sharing mode in which the accident event is detected, wherein upon detecting, by the impact detector, the accident event occurring with respect to the vehicle, the controller is configured to control a peripheral vehicle to transmit the recorded data to the external server.

2. The apparatus of claim 1, wherein the communication unit receives the recorded data from the external server based on an access authority set for the recorded data.

3. The apparatus of claim 2, wherein the access authority is set in phases for at least one data type included in the recorded data.

4. The apparatus of claim 2, wherein the access authority is set for an entity that accesses the recorded data.

5. The apparatus of claim 2, wherein the access authority is set based on whether the vehicle and the peripheral vehicle are manufactured by the same manufacturer.

6. The apparatus of claim 1, wherein the recorded data comprises at least one of driving information corresponding to the accident event, location information corresponding to the accident event, and an external image corresponding to the accident event.

7. The apparatus of claim 1, wherein the controller sets an access authority by generating recorded data comprising the external image, and the communication unit transmits recorded data for which the access authority is set to the external server.

8. The apparatus of claim 1, wherein the external server is configured to provide a social networking service (SNS).

9. A vehicular image processing apparatus mountable in a vehicle, the apparatus comprising:

a camera module to acquire an external image of the vehicle;

a controller to generate recorded data comprising the external image, wherein the controller sets an access authority for the generated recorded data corresponding to an accident event when it is detected the accident event occurs in a vicinity of the vehicle; and a communication unit to transmit the recorded data to a backup server in a normal mode, and automatically transmit the recorded data for which the access authority is set to an external server to be shared via a network upon detecting the accident event by the controller.

10. The apparatus of claim 9, wherein the controller analyzes the acquired external image, and generates the recorded data corresponding to the accident event when an occurrence of the accident event is verified.

11. The apparatus of claim 9, further comprising:

a microphone to acquire an external sound of the vehicle, wherein the controller analyzes the acquired external sound, and generates recorded data corresponding to the accident event when an occurrence of the accident event is verified.

12. A data sharing method of a vehicular image processing apparatus mountable in a vehicle, the method comprising:

acquiring, by using a camera module in the vehicle, an external image of the vehicle;

determine an operation mode based on the external image acquired by the camera module;

detecting an accident event occurring with respect to the vehicle;

uploading the external image of the vehicle to a backup server in response to determining that the operation mode is a normal mode in which the accident event is not detected;

uploading the external image of the vehicle to an external server to be shared via a network in response to determining that the operation mode is a sharing mode in which the accident event is detected and controlling a peripheral vehicle to transmit recorded data associated with the accident event to the external server;

accessing the external server to request for the recorded data associated with the accident event in the external server; and receiving the recorded data from the external server.

13. The method of claim 12, further comprising:

communicating with the external server to receive the recorded data.

14. The method of claim 13, wherein the communicating comprises receiving the recorded data from the external server based on an access authority set for the recorded data.

15. The method of claim 14, wherein the access authority is set in phases for at least one data type included in the recorded data.

16. The method of claim 14, wherein the access authority is set for an entity that accesses the recorded data based on whether the vehicle and the peripheral vehicle are manufactured by the same manufacturer.

* * * * *